United States Patent [19]

DiNicolantonio et al.

[11] Patent Number: 4,457,364

[45] Date of Patent: Jul. 3, 1984

[54] CLOSE-COUPLED TRANSFER LINE HEAT EXCHANGER UNIT

[75] Inventors: Arthur R. DiNicolantonio, Whippany, N.J.; Bill Moustakakis, Waterloo, Belgium

[73] Assignee: Exxon Research & Engineering Co., Florham Park, N.J.

[21] Appl. No.: 359,197

[22] Filed: Mar. 18, 1982

[51] Int. Cl.[3] ..... F28F 9/00

[52] U.S. Cl. ..... 165/134 R; 48/190; 165/174; 165/178; 165/DIG. 14; 285/155

[58] Field of Search ..... 165/174, 178, 134 R, 165/DIG. 14; 208/48 Q; 285/155, 176, 132; 48/190, 191, 192

[56] References Cited

U.S. PATENT DOCUMENTS

| | | | |
|---|---|---|---|
| 2,082,403 | 6/1937 | Larkin | 165/174 X |
| 2,762,635 | 9/1956 | Lorber | 285/155 |
| 3,357,485 | 12/1967 | O'Sullivan et al. | 165/174 |
| 3,421,781 | 1/1969 | Spurk | 285/176 |
| 3,449,212 | 6/1969 | Dorn | 196/136 |
| 3,456,719 | 7/1969 | Palchik | 165/142 |
| 3,552,487 | 1/1971 | Tokumitsu et al. | 165/174 |
| 3,574,781 | 4/1981 | Racine et al. | 260/683 |
| 3,583,476 | 6/1971 | Woebcke et al. | 165/1 |
| 3,641,119 | 2/1972 | Kivlen et al. | 260/683 |
| 3,671,198 | 6/1972 | Wallace | 23/277 |
| 3,763,262 | 10/1973 | Sato et al. | 260/683 |
| 3,910,347 | 10/1975 | Woebcke | 165/142 |
| 4,078,292 | 3/1978 | Porter | 29/402 |
| 4,097,544 | 6/1978 | Hengstebeck | 260/683 |
| 4,151,217 | 4/1979 | Amano et al. | 260/683 |
| 4,192,658 | 3/1980 | Worrell | 165/174 X |

FOREIGN PATENT DOCUMENTS 1077918 11/1965 United Kingdom .

OTHER PUBLICATIONS

"Ethylene", Chemical Week, Nov. 13, 1965, pp. 69, 72, 76.

Oil and Gas Journal, Feb. 1, 1971, pp. 70–73.

*Primary Examiner*—Sheldon J. Richter

*Attorney, Agent, or Firm*—Rebecca Yablonsky

[57] ABSTRACT

In thermal cracking of hydrocarbons, especially steam cracking to light olefins, a transfer line heat exchanger unit is provided in which cracked gas flows from a furnace into heat exchange tubes, which comprises a distributor having an inlet for said gas and two or three diverging branches forming with said distributor a wye or tri-piece for passage of gas, each branch having along its length a substantially uniform cross-sectional area and being in fluid flow communication with a respective cooling tube. Unfired residence time and pressure drop are reduced, thereby improving selectivity to ethylene.

21 Claims, 7 Drawing Figures

FIG. 2C
CROSSECTIONAL AREA ON LINE C–C

FIG. 2B
CROSSECTIONAL AREA ON LINE B–B

FIG. 2A
CROSSECTIONAL AREA ON LINE A–A

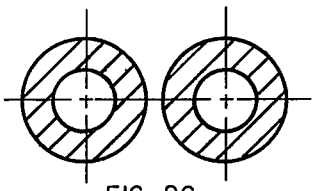
FIG. 2C
CROSSECTIONAL AREA ON LINE C—C
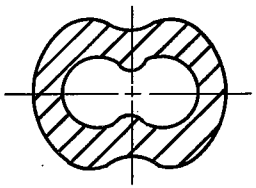
FIG. 2B
CROSSECTIONAL AREA ON LINE B—B
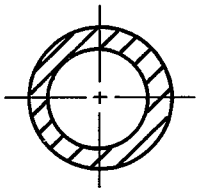
FIG. 2A
CROSSECTIONAL AREA ON LINE A—A
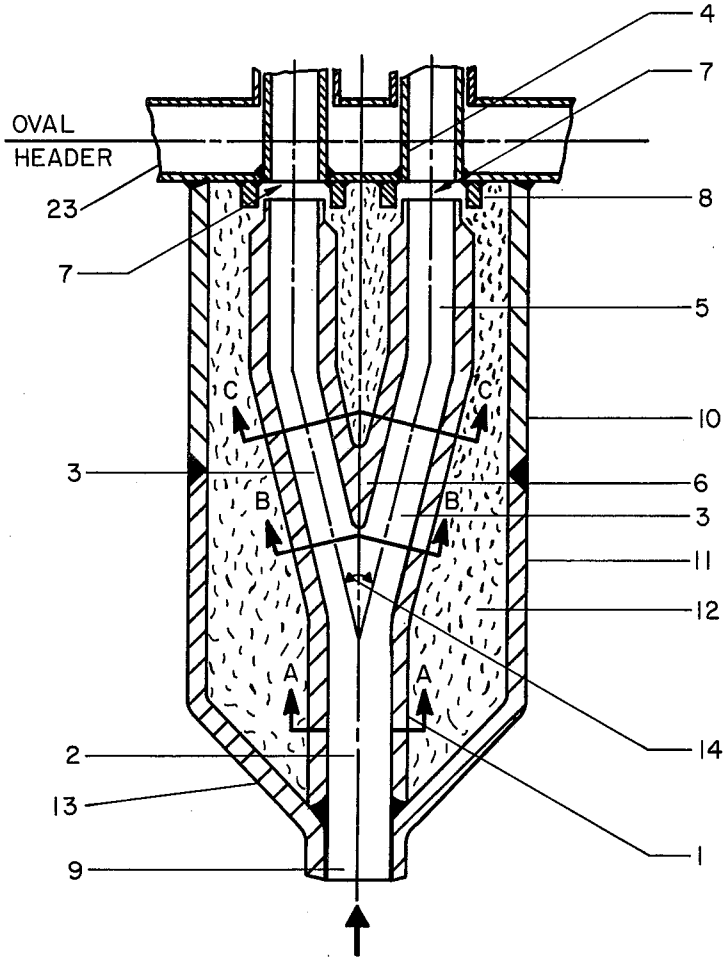

CLOSE-COUPLED TRANSFER LINE HEAT EXCHANGER UNIT

FIELD OF THE INVENTION

This invention relates to a novel apparatus for the close coupling of furnace tubes, particularly radiant tubes of a cracking furnace, to heat exchangers in a transfer line.

Steam cracking is a well-known process and is described in U.S. Pat. No. 3,641,190 and British Patent No. 1,077,918, the teachings of which are hereby incorporated by reference. In commercial practice, steam cracking is carried out by passing a hydrocarbon feed mixed with 20–90 mol % steam through metal pyrolysis tubes located in a fuel fired furnace to raise the feed to cracking temperatures, e.g., about 1400° to 1700° F. and to supply the endothermic heat of reaction, for the production of products including unsaturated light hydrocarbons, particularly $C_2$–$C_4$ olefins and diolefins, especially ethylene, useful as chemicals and chemical intermediates.

BACKGROUND OF THE INVENTION

The cracked effluent may be cooled in a heat exchanger connected to the furnace cracked gas outlet by a transfer line, which is thus termed a transfer line exchanger (TLE). Conventionally, the cracked gas from many reaction tubes is manifolded, passed into the expansion cone of a TLE, then through a tube sheet and into the cooling tubes of a multitube shell and tube TLE in order to cool the gas and generate steam.

In conventional TLE's the cracked gas is distributed to the cooling tubes by the inlet chamber. Since the cross sectional area of the TLE tubesheet is large compared to the area of the inlet nozzle and outlet collection manifold, the cracked gas must expand when leaving the manifold and contract again when entering the cooling tubes. In a typical exchanger, the velocity drops from 450 ft/sec at the inlet nozzle to 60 ft/sec before entering the cooling tubes. Once in the cooling tubes, the velocity is increased again to approximately 300 ft/sec; this expansion and contraction of the cracked gas coupled with its low velocity in the exchanger inlet chamber causes turbulence and uncontrolled residence time. This uncontrolled residence time causes a deterioration in the selectivity to desirable olefins, and coking. The heavier components and poly-nuclear aromatics in the cracked gas condense and polymerize to form coke in the inlet chamber. During process upsets or onstream decoking, this coke spalls and plugs the exchanger tubes causing a drastic increase in the exchanger pressure drop. Also, when hot gas strikes the dead flow zone caused by the tube sheet between the cooling tubes, heavier components and poly-nuclear aromatics suspended in the cracked gas are knocked out of the gas stream and condense and polymerize to form coke on the tube sheet between the cooling tubes. This coke deposit grows and gradually covers or blocks the entrance to the cooling tubes thus impeding heat transfer and causing the exchanger to lose its thermal efficiency. Furthermore such expansion and contraction of the cracked gas caused by large changes in velocity results in pressure loss, as discussed in U.S. Pat. No. 3,357,485. According to the present invention, these conditions are avoided and pressure loss is reduced.

In the conventional design there is a dramatic increase in velocity (when the gas enters the cooling tubes) which results in that the kinetic pressure loss is great as compared with a small static pressure gain to give an overall much greater pressure loss, as contrasted with the present invention in which there is no large or sudden increase in velocity so that the smaller loss in kinetic pressure as compared with the gain in static pressure gives an overall small pressure loss. Any decrease in velocity along the path of flow is gradual and relatively small as against the standard expansion cone, or velocity may be constant.

The flared expansion chamber is described in the following U.S. Pat. Nos.:

| | |
|---|---|
| 3,357,485 | 3,763,262 |
| 3,449,212 | 3,910,347 |
| 3,456,719 | 4,078,292 |
| 3,552,487 | 4,097,544 |
| 3,574,781 | 4,151,217 |

In U.S. Pat. No. 3,671,198 the outlet of each reaction tube is connected to a respective quench tube which is surrounded by a cooling jacket. This has the serious drawback that with a single quench tube fitted to a single reaction tube, in the event of plugging of the quench tube by coke, there will be loss of flow and subsequent failure of the reaction tube since the cracked gas will remain therein, will reach excessively high temperature and cause burnout. On the contrary, the subject heat exchange unit has at least two flow paths for the gas and the probability of both becoming plugged simultaneously is very low. This is an excellent safety feature.

As residence time and hydrocarbon partial pressure are decreased and cracking is carried out at higher radiant coil outlet temperatures, the selectivity to desirable olefins is improved. Accordingly, in recent years attention has been directed to the use of pyrolysis tubes affording short residence time, see for example an article entitled "Ethylene" in *Chemical Week,* Nov. 13, 1965 and U.S. Ser. No. 301,763 filed Sept. 14, 1981, of A. R. DiNicolantonio and V. K. Wei.

To capitalize on the benefits of very low residence time cracking, it is necessary to quench the effluent as quickly as possible in order to stop undesirable cracking reactions. To accomplish this, it is necessary to place the TLE as close as possible to the fired coil outlet to reduce the unfired residence time, i.e., the residence time measured from when the cracked process gas leaves the fired zone of the furnace to when it enters the TLE cooling tubes. It is also desirable to minimize turbulence and recirculation of the cracked gas between the fired outlet and TLE cooling tubes as this uncontrolled residence time causes a deterioration in the selectivity to desirable olefins and polymerization of the heavier components to coke. That is, the uncooled transfer line constitutes an adiabatic reaction zone in which reaction can continue, see The Oil and Gas Journal, Feb. 1, 1971.

It is highly desirable to reduce pressure build-up in the exchanger and loss of thermal efficiency. To accomplish this the dead flow zones between individual cooling tubes must be eliminated to prevent the heavy components in the cracked gas from condensing on these areas and eventually restricting cracked gas flow to the cooling tubes. These dead flow zones between the cooling tubes are not entirely eliminated by the devices described in U.S. Pat. No. 3,357,485.

From a process point of view, not only the unfired residence time needs to be minimized, but also the pressure drop in the transfer line and TLE outside of the fire box must be reduced to improve the selectivity, because large pressure drops result in increased pressure and increased hydrocarbon partial pressure in the upstream pyrolysis tubes connected thereto, which adversely affects the pyrolysis reaction, as aforesaid. As discussed above, pressure drops are lower in the configuration of the subject invention than in a conventional apparatus.

Another problem associated with the use of TLE's concerns the temperature transition from the inlet which receives hot gas from the furnace, to the cooler exchange tubes, and the desirability of reducing the thermal stress on metal parts with such a steep thermal gradient. In U.S. Pat. No. 3,853,476 a steam purged jacket is employed in the inlet of the exchanger for this purpose. Applicants achieve this objective without the use of expensive steam by means of a novel structuring of the inlet of their heat exchanger unit.

SUMMARY OF THE INVENTION

In thermal cracking of hydrocarbons especially steam cracking to light olefins, a transfer line heat exchanger unit is provided in which cracked gas flows from a furnace into heat exchange tubes, which comprises a connector or distributor having an inlet for said gas and two diverging branches forming with said connector a wye for passage of gas, each branch having along its length a substantially uniform cross-sectional area and being in fluid flow communication with a respective cooling tube. Thus, the device can be close-coupled to the radiant coils of the furnace because the path of gas flow is short since each branch of the wye leads directly into a cooling tube whereas the expansion chamber of a conventional TLE-which has to widen to accommodate a bundle of heat exchange tubes thus lengthening the path—is eliminated. Unfired residence time and pressure drop are reduced, thereby improving selectivity to ethylene.

A wye or a tri-piece may be used, with a suitable, relatively small angle of divergence between adjacent branches. Each branch has a substantially uniform cross-sectional area along its length preferably not varying by more than about 10 percent, more preferably not varying by more than about 5 percent.

The large expansion of gas in a conventional TLE inlet chamber with attendant large drop in velocity, is avoided. In the present invention the ratio, R, of the combined cross-sectional areas of the branches of the wye or of the tri-piece to the cross-sectional area of the connector may be expressed as:

R=about 1:1 to about 2:1, preferably about 1:1 to about 1.7:1.

Generally, each branch has a smaller cross-sectional area than the connector. By contrast to the above values for R, for the conventional TLE the ratio of the area at the expanded end of the cone to the area of the inlet will be much greater, about 10:1.

This configuration does not permit recirculation of the gas. Flow path of the gas is streamline. It is also tube sheet-free, that is, gas flows from the radiant tubes of the furnace into the wye or tri-piece, thence directly into the cooling tubes without obstruction. By appropriate choice of dimensions the gas velocity can be maintained substantially constant from the furnace outlet into the cooling tubes.

The unfired residence time is reduced from 0.05 seconds for a conventional TLE to 0.010–0.015 seconds. Very little coking occurs since the bulk residence time in the unfired section is significantly reduced and the uncontrolled residence time due to recirculation of gas in the standard TLE inlet chamber is eliminated. Consequently the unit is well adapted for use with very short residence time cracking tubes.

In order to minimize thermal stress, the wye or tri-piece is enclosed and surrounded by a specially designed jacket in fixed position with insulating material therebetween. The jacket or reducer has a variable cross-sectional area and diameter with variable insulation thickness, the smaller diameter and less insulation being at the hottest, inlet end of the connector. The wye or tri-piece and the reducer may suitably be made of a Cr-Ni/Nb alloy such as Manaurite 900B manufactured by Acieries du Manoir-Pompey, or Incoloy 800H. The insulating material may be, for example, refractory material such as medium weight castable, VSL-50, manufactured by the A. P. Green Company or Resco RS-5A manufactured by Resco Products, Inc.

BRIEF DESCRIPTION OF THE DRAWINGS

In the accompanying drawings.

FIG. 2 is a cross-sectional view of a wye and FIGS. 2A, 2B and 2C are sections taken on lines A—A, B—B, and C—C respectively, which sections are perpendicular to the direction of gas flow;

DETAILED DESCRIPTION

Figure 1:
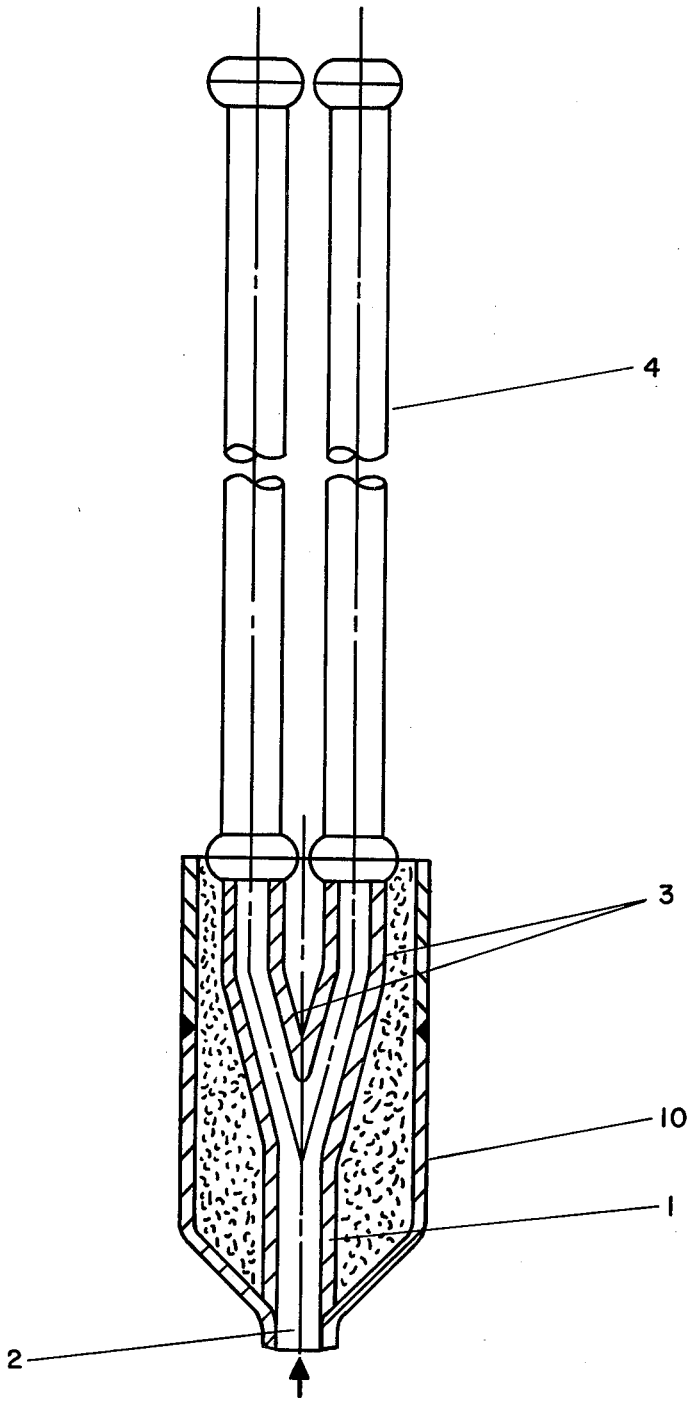
FIG. 1 is a schematic view of a transfer line heat exchanger unit according to the invention.

As shown in FIG. 1, the heat exchanger unit of this invention may comprise, in general, a wye 1 comprising a connector 2 and arms or branches 3 each of which leads into its respective cooling tube 4. The direction of gas flow is shown by the arrow. The wye 1 is enclosed in a jacket or reducer 10. A clean-out connection, not shown, may be provided upstream of the reducer.

FIG. 2 illustrates the wye in more detail. The connector 2 diverges, with a relatively small angle of divergence, into the two branches 3. The angle is selected to be small in order to avoid any abrupt changes in the direction of flow of the gas which could cause a pressure drop, and to make the structure compact. Suitably it may be, as measured between the central axes of the diverging branches, see the arrows 14, about 20° to about 40°, preferably about 30°. The branches straighten out and become substantially parallel in their downstream portions 5. This straightening is employed to confine erosion to the branches of the wye where an erosion allowance can be provided in the wall thickness. If the branches were not straightened prior to the gas entering the exchanger tubes, coke that might be contained in the gas would impinge on the thin walls of the exchanger cooling tube and erode a hole through the tube in a relatively short time. Where the connector enlarges to accommodate the branches, a baffle 6, formed by the intersection of the branches of the wye, is axially located to avoid or minimize expansion of the cross-sectional area of the flow path of the gas.

Thus, as shown in FIGS. 2A, 2B and 2C, in a preferred embodiment, the area at the line A—A is about the same as at the line B—B, for example 1870 $mm^2$, and at the line C—C the connector has already divided into two branches of roughly half said area each, for example 924 $mm^2$. Thus the ratio, R, of the sum of the cross-sectional areas of the branches to the cross-sectional area of the connector is roughly 1:1, e.g., 0.988. This ratio achieves substantially constant gas velocity throughout the wye. Suitably the cooling tubes are sized to match or approximate the areas of the respective wye branches, and in this illustration may be, for example, about 924 $mm^2$. The benefits of the invention can also be obtained to a large extent when R is greater than 1:1, up to about 2:1.

The cracked gas flows directly from the branches of the wye to the respective cooling tubes. There is no dead flow area such as a tube sheet in its flow path and therefore heavy ends in the cracked gas will remain suspended and not lay down as coke, blocking the flow area to the cooling tubes.

The portions 5 of the wye, at their downstream ends, are not attached to the respective cooling tubes 4 but each is spaced from the cooling tube by an expansion gap 7 and held in position by a collar 8.

The temperature transition from the hot inlet 9 of the distributor 2 which operates at approximately 1600°–1900° F. to the cooler exchanger tube 4 which may operate, e.g., at about 480° F. to about 612° F., is accomplished in a refractory filled alloy reducer 10. The reducer is welded to the distributor 2 and to the oval header 23 as shown to prevent leakage of gas into the atmosphere. The use of a reducer minimizes the thermal gradient and therefore reduces the thermal stress. A reducer has a variable cross-sectional area and diameter. The larger diameter end 11 of the reducer has more insulation 12 between its wall and the hot internal "Y" fitting than the small diameter end 13. Therefore, because of this variable insulation thickness, the small diameter end which operates at the hottest temperature expands or grows thermally approximately the same radial distance as the cooler, large diameter end. Since both ends of the reducer thermally grow approximately the same amount, thermal stresses are minimized. The "Y" piece distributor 2 which conducts the hot cracked gas to the cold exchanger tubes operates at the same temperature as the hot cracked gas. The "Y" piece is not physically attached to the cold exchanger tubes, and, therefore, there is no sharp temperature gradient and no thermal stress at this point. Rather, there is a thermal expansion gap 7 between the portions 5 of the "Y" and the exchanger cooling tubes 4 to permit unrestricted expansion of the hot branches of the "Y". Since there is a thermal expansion gap provided, the walls of the reducer 10 act as the pressure-containing member rather than the "Y" distributor.

Figure 3:
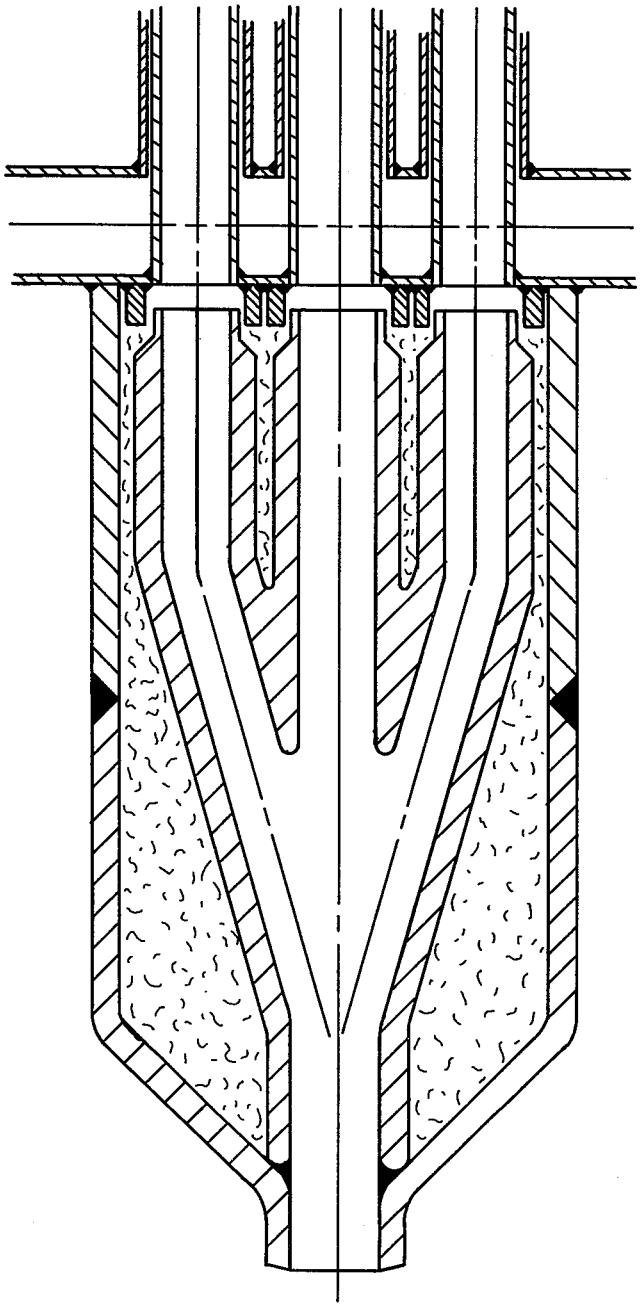
FIG. 3 is a cross-sectional view of a tri-piece.

Similar considerations as described above apply to the tri-piece, illustrated in FIG. 3.

Figure 4:
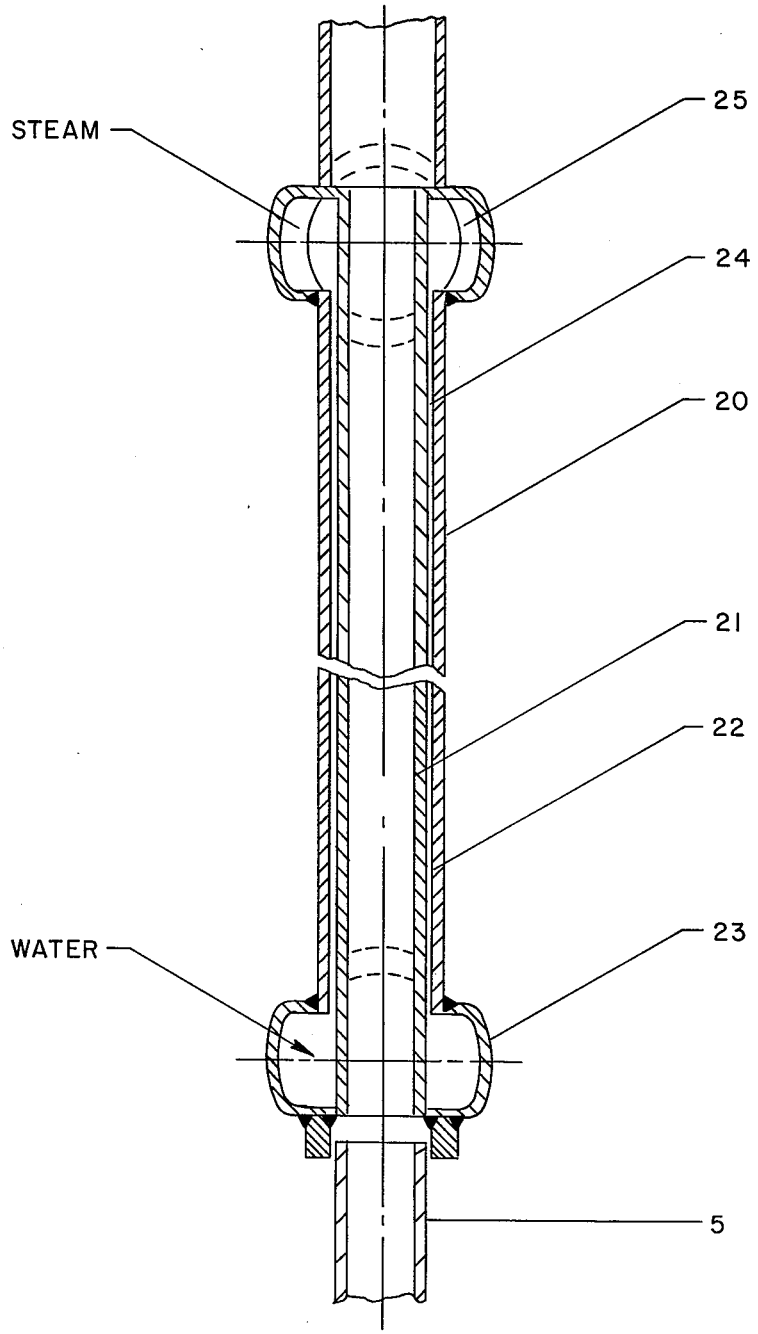
FIG. 4 is a cross-sectional view of one cooling tube of the unit.

FIG. 4 illustrates a single heat exchange tube which is in fluid flow communication with one branch of a wye. As shown, the downstream portion 5 of the branch is fitted to the cooling unit 20 so that gas can flow through the inner tube 21 which is jacketed by the outer shell 22. Water is passed via a header or plenum chamber 23 into the annular enclosure 24 between the tube-in-tube arrangement 21–22, takes up heat from the hot cracked gas and leaves as high pressure steam through header 25.

It will be understood that the furnace will be equipped with a large number of such transfer line heat exchanger units. The units may be located at the top or at the bottom of the furnace and, in either case, gas flow may be upflow or downflow.

The following examples are intended to illustrate, without limiting, the invention.

EXAMPLE 1

In this illustration two 1.35 inch I.D. (internal diameter) radiant tubes of a steam cracking furnace are joined together by an inverted wye fitting at the arch level of the furnace, flow of cracked gas with gas upflow is then conducted at constant velocity to the wye fitting of the heat exchanger unit of this invention, immediately upstream of the TLE cooling tubes. Gas flow is distributed at constant velocity to two 1.35 inch I.D. exchanger cooling tubes by this wye fitting. The ratio, R, is equal to 1.

For naphtha cracking at a steam (S) to hydrocarbon (HC) weight/weight ratio, of 0.65S/HC, the unfired residence time is about 0.012 seconds. Cooling tubes 27 feet long are required to cool the furnace effluent from 1573° F. (856° C.) to 662° F. (350° C.). For heavy gas oil (end boiling point above 600° F.) cracking, to avoid excessive coking in the cooling tubes, the preferred outlet temperatures are above 900° F. (482° C.) which requires only 13-feet-long tubes. For a light gas oil the same 27-feet-long exchanger tube may be used to cool the effluent to 720° F. (382° C.).

Table I summarizes comparative data as between a conventional (expansion chamber) TLE and the present invention, for naphtha cracking. The total pressure drop is given from the fired outlet to a point downstream of the outlet collection manifold or outlet head of the TLE. The unfired residence time is measured from just outside the furnace fire box to the inlet of the cooling tubes.

TABLE I

| | Conventional TLE | Present Invention |
|---|---|---|
| Total ΔP, psi | 5.1 | 2.0 |
| Unfired residence time, sec. | 0.0492 | 0.012 |
| Δ Ethylene, wt. % | −0.75 | Base |

It can thus be seen that if the present invention is used rather than the conventional TLE, 0.75 wt. % more ethylene is produced.

EXAMPLE 2

In this unit the I.D. of the distributor was 50.8 mm and of each branch of the wye was 43 mm. The angle of divergence was 30°. Since area$=\pi D^2/4$, the ratio, R, equals 1.43. The total pressure drop is approximately 1.9 psi from the fired outlet to a point downstream of the outlet collection manifold for the TLE cooling tubes.

EXAMPLE 3

In another unit, the distributor is a tube of the same diameter as the furnace radiant coil connected to it, 1.85 inch I.D. The tube splits into two branches, each having a 1.69 inch I.D. and each leading into a cooling tube of the same diameter. The ratio, R, equals 1.67. For steam cracking of propane, the cracked gas effluent is cooled in this unit from 1600° F. to 998° F. in cooling tubes 10.5 feet long. Total pressure drop is approximately 1.6 psi from the fired outlet to a point downstream of the cooling tubes.

The present invention therefore achieves close coupling of the TLE cooling tubes to the radiant coils of the furnace. Elimination of the collection manifold of numerous radiant coils and the TLE inlet chamber of the flared type, minimizes turbulence and recirculation of cracked gases between fired outlet and TLE cooling tubes. Thus, unfired residence time is reduced. These factors reduce non-selective cracking and subsequent coking in the unit. Smaller pressure drop decreases hydrocarbon partial pressure in the radiant coils and improves selectivity to ethylene. Operation without prequench upstream of the unit is permissable for gas cracking at high conversions. The elimination of prequench increases the furnace's thermal efficiency by producing more steam in the TLE due to higher TLE inlet temperature. A prequench system has a 1200° F. inlet whereas the closecoupled TLE system has about a 1600° F. inlet. Thus, the invention has substantial thermal efficiency advantages and achieves valuable yield credits.

What is claimed is:

1. A transfer line heat exchanger unit, close coupled to a furnace, in which hot gas flows from a furnace outlet into heat exchange tubes for cooling said gas which comprises heat exchange tubes of tube-in-tube construction, a connector connected at its upstream end to a furnace outlet and having an inlet for said gas and two diverging branches forming with said connector a wye for passage of gas, the ratio, R, of the sum of the cross-sectional areas of the branches to the cross-sectional area of the connector being from about 1:1 to about 2:1 and each branch being in fluid flow communication with a respective cooling tube, said cooling tubes being tube sheet-free, the cross-sectional area of each branch being substantially the same as the cross-sectional area of the respective cooling tube.

2. A unit according to claim 1 in which R is equal to about 1:1 to about 1.7:1.

3. A transfer line heat exchanger unit, close coupled to a furnace, in which hot gas flows from a furnace outlet into heat exchange tubes for cooling said gas which comprises heat exchange tubes of tube-in-tube construction, a connector connected at its upstream end to a furnace outlet and having an inlet for said gas and two diverging branches forming with said connector a wye for passage of gas, said wye having along its length a substantially uniform total cross-sectional area and each branch being in fluid flow communication with a respective cooling tube, said cooling tubes being tube sheet-free, the cross-sectional area of each branch being substantially the same as the cross-sectional area of the respective cooling tube.

4. A modification of a unit according to claim 1 in which said connector has three said diverging branches forming with said connector a tri-piece, said tri-piece having along its length a substantially uniform total cross-sectional area.

5. A unit according to claim 3 or in which the angle of divergence between the respective central axes of adjacent diverging branches is in the range of about 20° to 40°.

6. A unit according to claim 3 or in which the cross-sectional areas of the branches are substantially equal to one another.

7. A unit according to claim 3 or in which the cross-sectional area of a branch does not vary by more than about 10%.

8. A unit according to claim 3 or in which the branches straighten out into substantially non-diverging parallel sections which are in direct fluid flow communication with the respective cooling tubes.

9. A unit according to claim 3 or in which the gas flows from the furnace outlet into the cooling tubes essentially without expansion at constant velocity.

10. A unit according to claim 3 or 1 in which the furnace is steam cracking furnace.

11. A transfer line heat exchanger unit, close coupled to a furnace, in which hot gas flows from a furnace outlet into heat exchange tubes for cooling said gas which comprises heat exchange tubes of tube-in-tube construction, a connector connected at its upstream end to a furnace outlet and having an inlet for said gas and three diverging branches forming with said connector a tri-piece for passage of gas, the ratio, R, of the sum of the cross-sectional areas of the branches to the cross-sectional area of the connector being from about 1:1 to about 2:1 and each branch being in fluid flow communication with a respective cooling tube, said cooling tubes being tube sheet-free, the cross-sectional area of each branch being substantially the same as the cross-sectional area of the respective cooling tube.

12. A unit according to claim 11 in which R is equal to about 1:1 to about 1.7:1.

13. A transfer line heat exchanger unit, close coupled to a furnace, in which hot gas flows from a furnace outlet into heat exchange tubes for cooling said gas which comprises heat exchange tubes of tube-in-tube construction, a connector connected at its upstream end to a furnace outlet and having an inlet for said gas and three diverging branches in the same plane forming with said connector a tri-piece for passage of gas, said tri-piece having along its length a substantially uniform total cross-sectional area and each branch being in fluid flow communication with a respective cooling tube, said cooling tubes being tube sheet-free, the cross-sectional area of each branch being substantially the same as the cross-sectional area of the respective cooling tube.

14. A unit according to claim 13 in which the angle of divergence between the respective central axes of adjacent diverging branches is in the range of about 20° to 40°.

15. A unit according to claim 13 in which the cross-sectional areas of the branches are substantially equal to one another.

16. A unit according to claim 13 in which the cross-sectional area of a branch does not vary by more than about 10%.

17. A unit according to claim 13 in which the branches straighten out into substantially non-diverging parallel sections which are in direct fluid flow communication with the respective cooling tubes.

18. A unit according to claim 13 in which the gas flows from the furnace outlet into the cooling tubes essentially without expansion at constant velocity.

19. A transfer line heat exchanger unit, close coupled to a steam cracking furnace, in which hot gas flows from a furnace outlet into heat exchange tubes for cooling said gas which comprises heat exchange tubes of tube-in-tube construction, a connector connected at its upstream end to a furnace outlet and having an inlet for said gas and two diverging branches forming with said connector a wye for passage of gas, said wye having along its length a substantially uniform total cross-sectional area and each branch being in fluid flow communication with a respective cooling tube, said cooling tubes being tube sheet-free; and in which a reducer is in fixed position enclosing the wye with insulation therebetween, the wye at its upstream end being affixed to the reducer, the diameter of the reducer and amount of insulation being smallest at the upstream end, a thermal expansion gap being provided between the branches of the wye and the respective cooling tubes.

20. A transfer line heat exchanger unit, close coupled to a steam cracking furnace, in which hot gas flows from a furnace outlet into heat exchange tubes for cooling said gas which comprises heat exchange tubes of tube-in-tube construction, a connector connected at its upstream end to a furnace outlet and having an inlet for said gas and three diverging branches in the same plane forming with said connector a tri-piece for passage of gas, said tri-piece having along its length a substantially uniform total cross-sectional area and each branch being in fluid flow communication with a respective cooling tube, said cooling tubes being tube sheet-free; and in which a reducer is in fixed position enclosing the tri-piece with insulation therebetween, the tri-piece at its upstream end being affixed to the reducer, the diameter of the reducer and amount of insulation being smallest at the upstream end, a thermal expansion gap being provided between the branches of the tri-piece and the respective cooling tubes.

21. A transfer line heat exchanger unit, close coupled to a furnace, in which hot gas flows from a furnace outlet into heat exchange tubes for cooling said gas which comprises heat exchange tubes of tube-in-tube construction, a connector connected at its upstream end to a furnace outlet and having an inlet for said gas and two or three diverging branches forming with said connector a wye or tri-piece for passage of gas, the ratio, R, of the sum of the cross-sectional areas of the branches to the cross-sectional area of the connector being from about 1:1 to about 2:1 and each branch being in fluid flow communication with a respective cooling tube, said cooling tubes being tube sheet-free, and in which a reducer is in fixed position enclosing the wye or tri-piece with insulation therebetween, the wye or tri-piece at its upstream end being affixed to the reducer, the diameter of the reducer and amount of insulation being smallest at the upstream end, a thermal expansion gap being provided between the branches of the wye or tri-piece and the respective cooling tubes.

* * * * *

UNITED STATES PATENT OFFICE
CERTIFICATE OF CORRECTION

Patent No. 4,457,364 Dated July 3, 1984

Inventor(s) Arthur R. DiNicolantonio and Bill Moustakakis

It is certified that error appears in the above-identified patent and that said Letters Patent are hereby corrected as shown below:

In claims 5, 6, 7, 8 and 9, line 1 of each, cancel "or".

In claim 10, line 2, after "is" insert -- a --.

Signed and Sealed this

*Twenty-third* Day of *October 1984*

[SEAL]

*Attest:*

GERALD J. MOSSINGHOFF

*Attesting Officer*

*Commissioner of Patents and Trademarks*